US009441385B1

(12) United States Patent
Tsyukalo

(10) Patent No.: US 9,441,385 B1
(45) Date of Patent: Sep. 13, 2016

(54) DRYWALL CUTTING APPARATUS AND READY PATCHES AND METHOD

(71) Applicant: Sergey Petrovich Tsyukalo, Spokane, WA (US)

(72) Inventor: Sergey Petrovich Tsyukalo, Spokane, WA (US)

( * ) Notice: Subject to any disclaimer, the term of this patent is extended or adjusted under 35 U.S.C. 154(b) by 0 days.

(21) Appl. No.: 14/658,217

(22) Filed: Mar. 15, 2015

(51) Int. Cl.
*B23B 51/00* (2006.01)
*E04G 23/02* (2006.01)

(52) U.S. Cl.
CPC ..... *E04G 23/02* (2013.01)

(58) Field of Classification Search
CPC ... B23B 35/00; B23B 51/08; B23B 2200/00; B23B 2200/046
USPC ..... 408/1 R, 1 BD, 78, 80; 52/514, 741.1; 83/591, 594, 595, 596
See application file for complete search history.

(56) References Cited

U.S. PATENT DOCUMENTS 4,620,407 A * 11/1986 Schmid ..... E04G 23/02 156/98
5,878,639 A * 3/1999 Martinez ..... B26F 1/3846 52/742.12
6,162,525 A * 12/2000 Amy ..... E04F 21/02 156/71
6,729,811 B2 * 5/2004 Kamphuis ..... B23B 3/24 29/888.061
7,540,122 B2 * 6/2009 Trudeau ..... B23D 71/02 52/514
8,137,036 B2 * 3/2012 Wadley ..... B23B 49/026 408/1 R
2002/0094246 A1 * 7/2002 Jones ..... B23B 51/0426 408/1 R
2009/0010726 A1 * 1/2009 Brugman ..... B23Q 9/0042 408/1 R
2011/0103907 A1 * 5/2011 Martin ..... B23B 47/281 408/1 R

* cited by examiner

*Primary Examiner* — William Gilbert

(57) ABSTRACT

The Drywall Cutting Apparatus contains a circular knife-saw with an angled cut designed for the formation of a circular opening in a damaged wall or for the formation of a Circular Ready Patch component in a sheet of drywall. The Circular Ready Patch is a round drywall patch with an angled edge glued onto fiberglass mesh of a larger diameter than the patch. Its objective is to repair damaged walls in cooperation with the Drywall Cutting Apparatus. Kits of several different sizes containing the Drywall Cutting Apparatus, patches, taping knife, and spackling paste are created for walls with varying degrees of damage.

2 Claims, 4 Drawing Sheets

DRYWALL CUTTING APPARATUS AND READY PATCHES AND METHOD

CROSS-REFERENCE TO RELATED APPLICATION

This application claims priority to U.S. provisional patent application 62/018,583 filed 28 Jun. 2014, the entire contents of which are hereby incorporated by reference.

FIELD OF INVENTION

The invention pertains to drywall, specifically to the drilling of openings in damaged drywall, and the succeeding repair.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Many companies use drywall for walls and ceilings during the process of construction. However, walls and ceilings constructed out of drywall have a significant flaw. They are prone to damage, and holes can be formed from sudden impact.

There are many available methods for the repair of walls. These methods include various kinds of plastics, various kinds of paper, complex devices with metal nets, bolts, racks, templates, membranes, and much more.

Drywall is often damaged in spots that were previously used for the installation of different mounts such as those used for TVs, from the installation of shelves, from contact with objects such as door handles, or simply due to vandalism. The drywall must retain the same level of structural integrity after repair that it had prior to the damage.

A good method of wall repair was proposed by Roy Schmid. Inventor Roy Schmid. Method for drywall patching. U.S. Pat. No. 4,620,407 A The patch is made from the same material as the drywall. This is practical when walls are subsequently needed to drill in screws, hammer in nails, etc. However, a significant disadvantage of this method is the difficulty of using a template. This method of wall repair takes a lot of time and is therefore, of little use.

Some patches are so complex in their construction that they are unable to reach commercial recognition. Inventor Ira Amy. Drywall patch. U.S. Pat. No. 6,162,525 A The fiberglass mesh on Ira Amy's invention is attached to the front side of the patch with the help of additional paper and glue. A special workplace and a lot of time are required to create a patch and perform the necessary repair through Ira Amy's method.

Another invention pertaining to the repair of drywall was created by Antonio Martinez. Inventor Antonio Armando Murua Martinez. Wall surface cutting and repairing apparatus and method. U.S. Pat. No. 5,878,639 A.

The invention of Antonio Armando Murua Martinez is intended for forming openings. This invention works well when the area of the wall into which the drywall screws with winged heads, are to be fastened is undamaged, so that the cutting and repairing apparatus will be fastened securely to the wall. However, the opening usually needs to be formed on the damaged surface, precisely the spot where the cutting and repairing apparatus needs to be secured according to Antonio Armando Murua Martinez's method.

BRIEF SUMMARY OF THE INVENTION

The advantages of the present invention will be clear from the following detailed description and drawings. The present invention considers the main drawbacks of previous inventions and presents a Circular Ready Patch that is pre-made and does not require working with small parts directly at the workplace. The strength of the Circular Ready Patch is enhanced via the Circular Ready Patch's angle and via the fiberglass mesh, which covers the patch completely from the rear, interior side; the protruding edges of the fiberglass mesh remaining on the front, exterior, side are covered in spackling paste, making this area of the wall extremely durable after repair. The Circular Ready Patch comes in a variety of sizes.

The Drywall Cutting Apparatus (FIG. 1) has an inward angled knife-saw (11) and spikes (16) which attach to the wall from the outside and guarantee safe working conditions. A groove (14) is also installed on the edge of the cover (13), which contains a gasket sponge (15) to prevent dust and debris from flying out, making repairs more accessible in buildings with higher demands in regard to a clean work environment. The knife-saw (11) of the Drywall Cutting Apparatus can be angled outward instead of inward and can thus be used to create a Circular Ready Patch component.

The invention also presents the Square Ready Patch, which is intended for the repair of walls in places which the Drywall Cutting Apparatus is unable to access due to its dimensions, such as under the sink, behind the toilet, or in another tight space. The Square Ready Patch also comes in various shapes.

An objective of the present invention is to provide a speedy method of repairing drywall with the help of the Drywall Cutting Apparatus and Circular Ready Patch.

It is a further objective of the present invention to provide the user of the Drywall Cutting Apparatus with a circular cut with an angled edge.

It is a further objective of the present invention to provide a method of creating a Circular Ready Patch component (35) by use of the Drywall Cutting Apparatus and outward-angled knife-saw (33).

It is a further objective of the present invention to provide safe work with the knife-saw, which is held back by a limiter and does not reach deep into the wall, where damage of electrical components or plastic pipes would occur.

It is a further objective of the present invention to provide a method of repairing drywall in places where the Drywall Cutting Apparatus cannot be used by instead using the Square Ready Patch.

It is a further objective of the present invention to repair the wall so that it is indistinguishable from an original one.

DETAILED DESCRIPTION OF THE INVENTION

Figure 1:
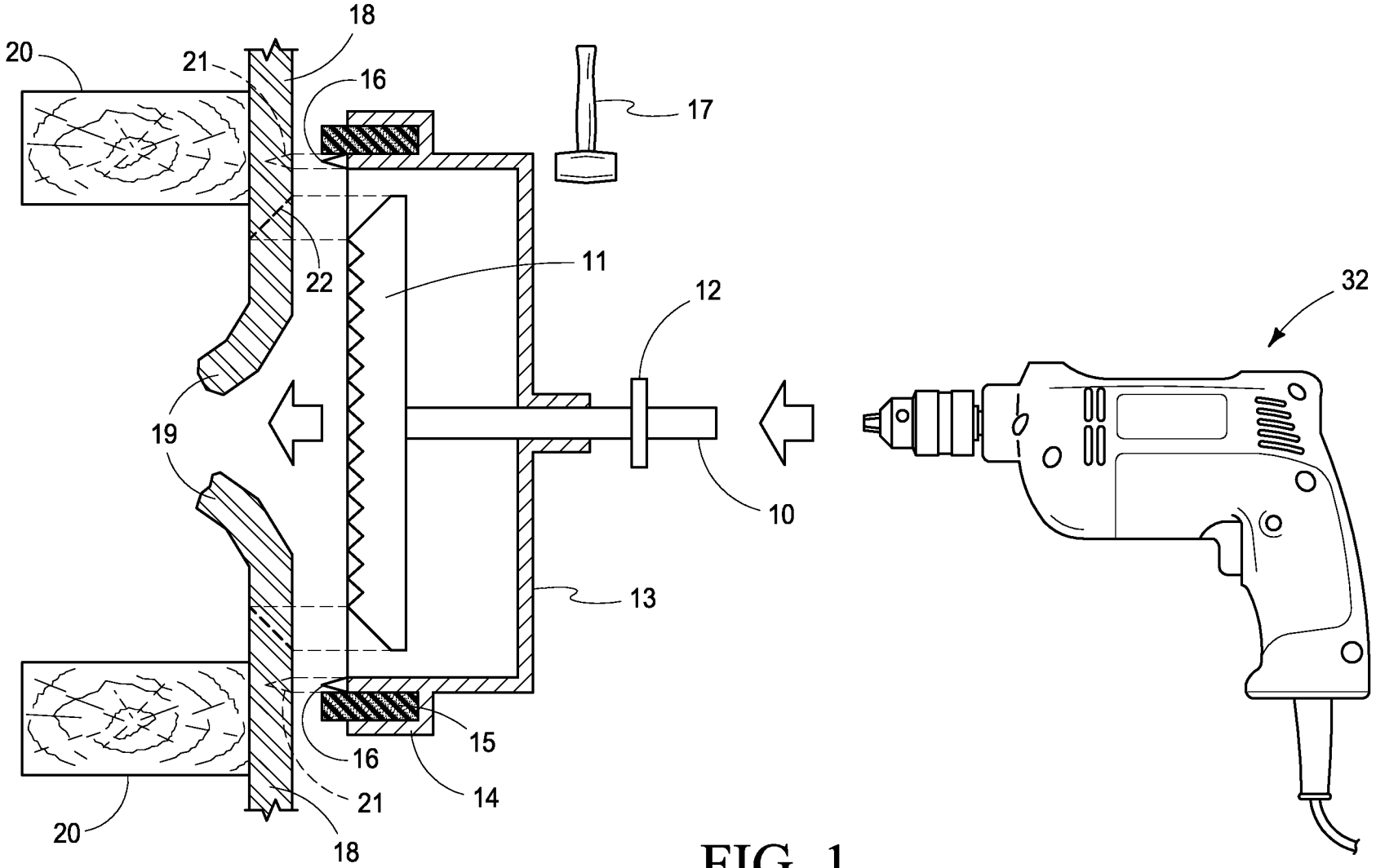
FIG. 1 is a side cutaway view of the Drywall Cutting Apparatus with knife-saw angled inward, in accordance with the invention.

The preferred embodiment of the Drywall Cutting Apparatus is shown in FIG. 1.

The main element of the Drywall Cutting Apparatus is the knife-saw (11), which is attached by way of a metal rod (10). The rod contains a depth limiter (12), which regulates the depth of the cut into the drywall so that all electrical components, plastic piping, wall studs (20), and anything else that is hidden and tucked inside and or behind the wall is saved from damage.

The second important element of the Drywall Cutting Apparatus is the cover (13). The cover is constructed out of metal, but may be made from other material, and its edges have spikes installed (16) that are driven into the wall (18) with a hammer (17) by repeated hits on the cover (13). These spikes secure the Drywall Cutting Apparatus upon entering the wall (21), guaranteeing safe work, while the damaged part of the wall (19) remains inside the cover (13). The gasket sponge (15) is found on the outside, on the edge of the cover (13), and is inserted into a special slot (14) made around the cover (13). Its function is to prevent the escape of dust and debris. When the Drywall Cutting Apparatus is planted on the wall (18), an electric drill (32) is connected to its rod (10) and a circular opening with an angled cut on its edge (22) is cut out by pressing the inward-angled knife-saw (11) with the drill to the wall (18).

The Drywall Cutting Apparatus also has another function; it can be used to create the main component of the Circular Ready Patch. Instead of angling inward (11), the knife-saw angles outward (33), and in the method described above, the Drywall Cutting Apparatus is used to cut the Circular Ready Patch component (35) from a sheet of drywall (34).

Figure 3:
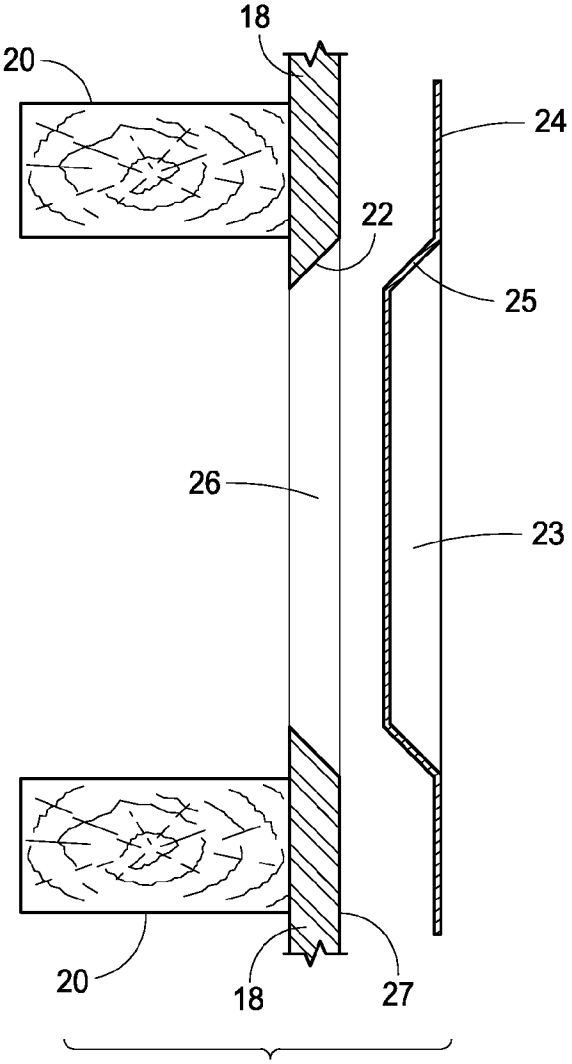
FIG. 3 is a side cutaway view of the Circular Ready Patch, which is illustrated in FIG. 2 in accordance with the invention.
Figure 2:
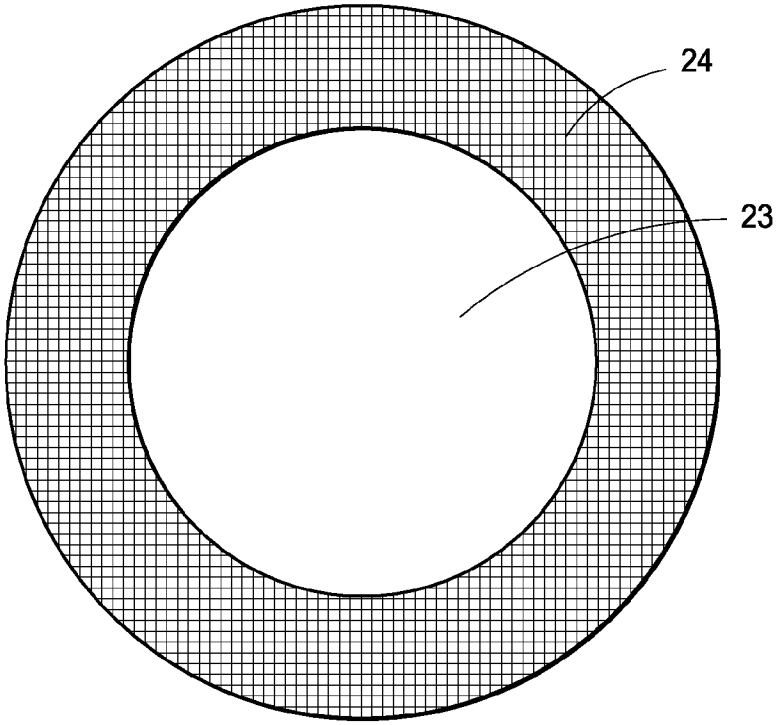
FIG. 2 is front view of the Circular Ready Patch in accordance with the invention.

The preferred embodiment of the Circular Ready Patch is shown in FIG. 2 and FIG. 3. Its main element is the Circular Ready Patch, which is composed of a circular part of drywall (23), and has the same angle of cut (25) as the one performed by the inward-angled knife-saw. However, the Circular Ready Patch (23) is slightly smaller than the drilled opening (26) of the damaged wall to allow room for the spackling paste. The Circular Ready Patch (23) is glued onto fiberglass mesh (24) which is larger in diameter than the Circular Ready Patch itself. The Circular Ready patch can also be made by placing fiberglass mesh into a pre-made form and pouring a substance over it such as quick-setting drywall mud. When an opening (26) is cut out in the damaged wall (18), a layer of spackling paste is applied to the angled cut (25) of the Circular Ready Patch and onto the edges of the wall opening if desired. The Circular Ready Patch is inserted into the opening (26), and the edges of the fiberglass mesh (24) remain on the front part of the wall (27). The entire front portion of the Circular Ready Patch is covered with spackling paste with the help of a steel taping knife.

Figure 5:
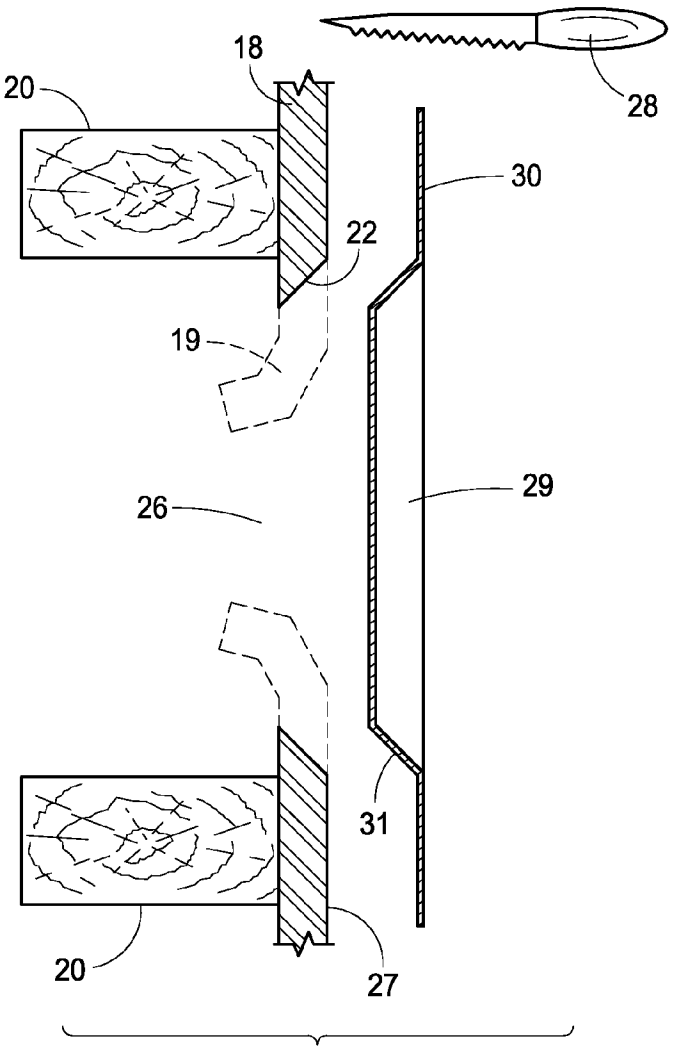
FIG. 5 is a side cutaway view of the Square Ready Patch, which is illustrated in FIG. 4 in accordance with the invention.
Figure 4:
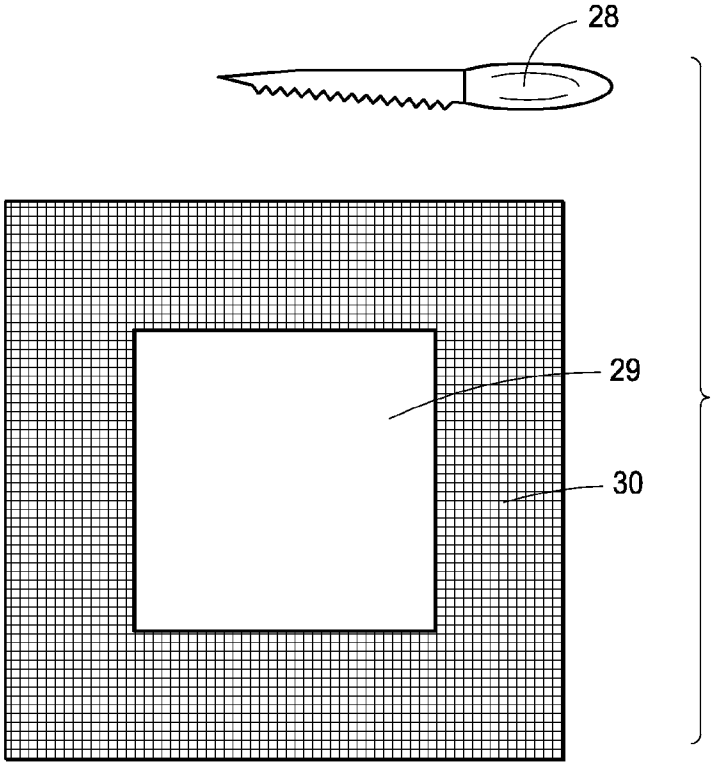
FIG. 4 is a front view of the Square Ready Patch in accordance with the invention.
Figure 6:
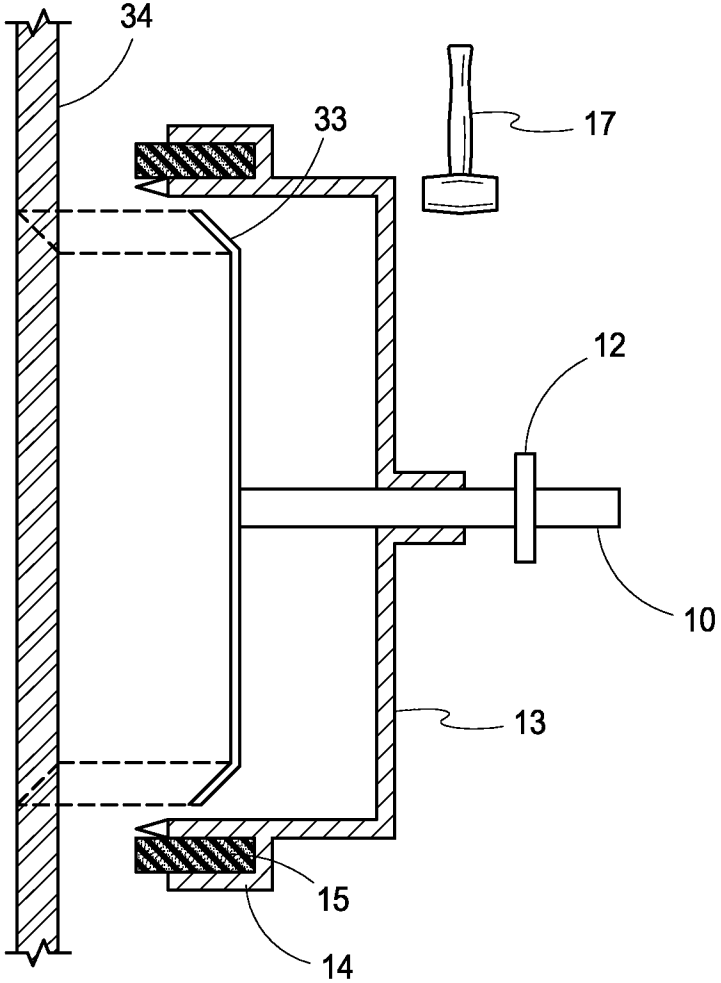
FIG. 6 is a side cutaway view of the Drywall Cutting Apparatus with knife-saw angled outward, in accordance with the invention.
Figure 7:
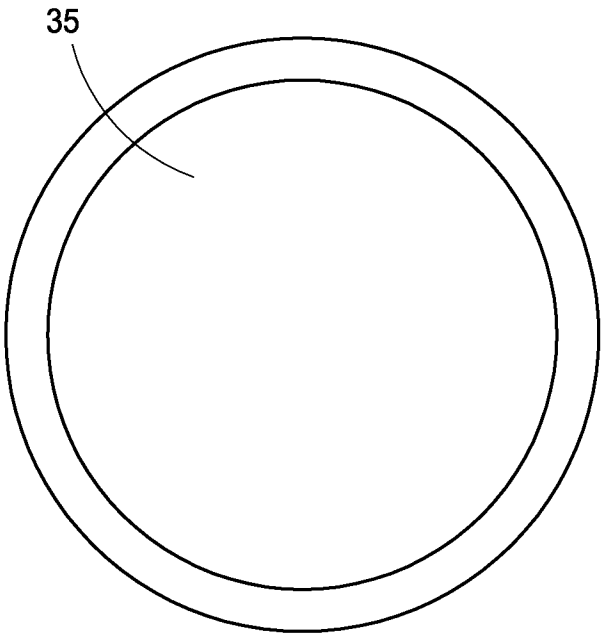
FIG. 7 is a front view of the Circular Ready Patch component in accordance with the invention.

The preferred embodiment of the Square Ready Patch is shown in FIG. 4 and FIG. 5. However, it is not limited to a square shape only; it can consist of other shapes. The predominant element is the Square Ready Patch, which is composed of a square piece of drywall (29), contains an angled cut (31), and is glued onto fiberglass mesh (30) of larger dimensions. The Square Ready Patch is intended for the repair of walls in places which the Drywall Cutting Apparatus is unable to access due to its dimensions, such as under the sink, behind the toilet, or in another tight space. The Square Ready Patch also includes a sticker of the same size as the patch. The sticker is attached to the damaged part of the wall (18) and the drywall saw (28) cuts out a hole the same size as the Square Ready Patch by tracing the contours of the sticker. An opening is thus made in the wall with this drywall saw. It is not necessary to maintain a precise angle of the cut in the wall, but an angled cut must be made. A layer of spackling paste is applied to the angled cut (31) of the Square Ready Patch and onto the edges of the wall opening if desired. The Square Ready Patch is inserted into the opening (26), and the edges of the fiberglass mesh (30) remain on the front part of the wall (27). The entire front portion of the Square Ready Patch is covered with spackling paste with the help of a steel taping knife.

I claim:

1. A method of repairing damaged drywall, comprising:

providing a drywall cutting apparatus, said drywall cutting apparatus having a cover with a perimeter and having an aperture extending therethrough, a first spike and a second spike attached to said cover and positioned about said perimeter; a rod placed within said aperture and having a knife-saw disposed at a first end of said rod, said knife-saw having a thickness about a perimeter that converges in a direction from proximal to distal of said cover;

placing said cover over a damaged area of drywall;

securing said cover to said drywall by driving said spikes into said drywall;

attaching a second end of said rod to an electric drill;

making an angled cut by using said drill and said knife-saw to form said angled cut at said damaged area of said drywall;

removing said cutting apparatus and disposing said damaged area;

applying a layer of spackling paste to said angled cut;

placing a circular patch into and opening formed by said removing of said damaged area, said circular patch comprising a fiberglass mesh having a first portion configured to be received in an opening formed by the removal of said damaged area, a second portion being a ring configured to be placed about a perimeter of said opening, and an angled portion connecting said first portion and said second portion and having an angle conforming to said angled cut, said first portion and said angled portion forming a partial enclosure and receiving a piece of drywall that substantially fills said partial enclosure;

smoothing the patch on a first side of said drywall; and, covering said patch with spackling paste.

2. A method of repairing damaged drywall, comprising:

providing a drywall cutting apparatus, said drywall cutting apparatus having a cover with a perimeter and having an aperture extending therethrough, a first spike and a second spike attached to said cover and positioned about said perimeter; a rod placed within said aperture and having a knife-saw disposed at a first end of said rod, said knife-saw having a thickness about a perimeter that diverges in a direction from proximal to distal of said cover;

placing said cover over a damaged area of drywall;

securing said cover to said drywall by driving said spikes into said drywall;

attaching a second end of said rod to an electric drill;

making an angled cut by using said drill and said knife-saw to form said angled cut at said damaged area of said drywall;

removing said cutting apparatus and disposing said damaged area;

applying a layer of spackling paste to said angled cut;

placing a circular patch into and opening formed by said removing of said damaged area, said circular patch comprising a fiberglass mesh having a first portion configured to be received in an opening formed by the removal of said damaged area, a second portion being a ring configured to be placed about a perimeter of said opening, and an angled portion connecting said first portion and said second portion and having an angle conforming to said angled cut, said first portion and said angled portion forming a partial enclosure and receiving a piece of drywall that substantially fills said partial enclosure;

smoothing the patch on a first side of said drywall; and, covering said patch with spackling paste.

* * * * *